United States Patent [19]

Dzhaparidze et al.

[11] 4,140,617

[45] Feb. 20, 1979

[54] ANODE FOR PRODUCING ELECTROLYTIC MANGANESE DIOXIDE

[76] Inventors: Levan N. Dzhaparidze, ulitsa Saburtalinskaya, 37, kv. 9, Tbilisi; Yanzhe M. Dubov, ulitsa Vokzalnaya, 30, Moskovskaya oblast, Odintsovo, poselok Bakovka; Eduard A. Bogdanov, tupik Tsulukidze, 2, kv. 10; Temuri A. Chakhunashvili, ulitsa Plekhanova, 2/8, both of Tbilisi; Georgy T. Gogoladze, ulitsa Chavchavadze, 6, kv. 44, Rustavi, Gruzinskaya SSR; Alla A. Teisheva, ulitsa Panfilova, 10, kv. 40, Moscow; Galina N. Ryzygraeva, ulitsa Festivalnaya, 65, kv. 706, Moscow; Mikhail A. Melnikov-Eikhenvald, ulitsa Vavilova, 12, kv. 18, Moscow; Temuri V. Rokva, ulitsa Megrelidze, 16, Tbilisi, all of U.S.S.R.

[21] Appl. No.: 798,098

[22] Filed: May 18, 1977

[30] Foreign Application Priority Data

May 25, 1976 [SU] U.S.S.R. ..... 2367512

[51] Int. Cl.[2] ..... C25B 11/10; C25B 11/02; C25B 1/30

[52] U.S. Cl. ..... 204/290 F; 204/82; 204/96

[58] Field of Search ..... 204/290 F, 290 K, 82, 204/96

[56] References Cited

U.S. PATENT DOCUMENTS

| | | | |
|---|---|---|---|
| 2,929,769 | 3/1960 | Newell et al. | 204/290 F |
| 2,979,553 | 4/1961 | McCullum | 429/206 |
| 3,313,721 | 4/1967 | Teel | 204/290 F X |
| 3,616,302 | 10/1971 | Osawa et al. | 204/40 |
| 4,051,000 | 9/1977 | Gendron et al. | 204/106 |

OTHER PUBLICATIONS

Kokhnov et al., Translated from Elektrokhimiya, vol. 9, No. 1, pp. 30–33, Jan. 1973.

*Primary Examiner*—F. C. Edmundson
*Attorney, Agent, or Firm*—Steinberg & Blake

[57] ABSTRACT

The proposed anode for producing electrolytic manganese dioxide is made of titanium, and its surface is provided with a coating to prevent passivation of the anode. On the anode surface there are provided hollows whose total surface area is not less than 10 percent of that of the anode. Said coating is arranged in these hollows and comprises two layers. The first layer is of a metal selected from the platinum family; it may also be of ruthenium dioxide or platinum oxide and has a thickness of 0.8 to 5 mu; it may also be of lead dioxide and in that case has a thickness of 0.1 to 1 mm. The second layer is of manganese dioxide and has a thickness of 1 to 2 mm.

The proposed method for manufacturing the above anode used to produce electrolytic manganese dioxide comprises the following steps. The surface of an anode of titanium is provided with hollows whose total surface area is not less than 10 percent of that of the anode. The hollows are then provided with a coating which is intended to prevent passivation of the anode and is composed of two layers. The first, inner, layer of said coating is of a metal selected from the platinum family, ruthenium dioxide or platinum oxide and has a thickness of 0.8 to 5 mu. It may also be of lead dioxide and in that case has a thickness of 0.1 to 1 mm. The second, outer, layer of said coating is of manganese dioxide and has a thickness of 1 to 2 mm, which is produced from an aqueous solution of manganese sulphate by electrodeposition which is carried out during 20 to 100 hours at an anode current density of 5 to 100 A/m$^2$.

6 Claims, 7 Drawing Figures

ANODE FOR PRODUCING ELECTROLYTIC MANGANESE DIOXIDE

The present invention relates to electrodes and, more particularly, to anodes for producing electrolytic manganese dioxide to be used in the manufacture of voltaic cells, as well as methods for manufacturing such anodes.

There is known an anode for producing electrolytic manganese dioxide from manganese sulphate solutions, manufactured from titanium precoated with a uniform dense layer of manganese dioxide. The uniform dense layer of manganese dioxide is produced by thermal decomposition of manganese nitrate.

The foregoing type of anode is disadvantageous in that it does not prevent an increase in the transition resistance on the titanium-manganese dioxide boundary and damage of the manganese dioxide sublayer during removal of the product (electrolytic manganese dioxide), which necessitates the renewal of the sublayer prior to each operating cycle, i.e. once in 10 to 30 days.

There is also known an anode for producing electrolytic manganese dioxide from manganese sulphate solutions, made of titanium and covered all over with a layer of a metal selected from the platinum family.

The latter type of anode is disadvantageous in that its manufacture requires considerable amounts of a metal of the platinum family due to the fact that the entire anode surface has to be covered with that metal. In addition, removal of the manganese dioxide deposit causes mechanical damage of the layer of noble metal which is lost irretrievably.

It is an object of the present invention to provide an anode for producing electrolytic manganese dioxide with a prolonged service life.

It is another object of the invention to reduce the consumption of metals of the platinum family.

The objects of the present invention are attained by providing an anode to produce electrolytic manganese dioxide, made of titanium and provided with a surface coating to prevent passivation of the anode, which anode has, in accordance with the invention, hollows on its surface, the total area of the hollows being not less than 10 percent of the total surface area of the anode, said coating being provided in said hollows and consisting of two layers, the first, inner, layer being of a metal of the platinum family, ruthenium dioxide or platinum oxide and having a thickness of 0.8 to 5 mμ, or lead dioxide, in which case it is 0.1 to 1 mm thick, whereas the second, outer, layer is of manganese dioxide and has a thickness of 1 to 2 mm.

Depending on the profile of the basic titanium material and the available equipment for working this material, the anode may be shaped as a plate provided with hollows which are grooves 0.5 to 1.5 mm in depth, or through holes with a diameter of 2 to 5 mm. The anode may also be shaped as a cylinder, the hollows being annular, spiral or longitudinally extending grooves 1 to 2 mm wide and 0.5 to 2 mm deep.

According to the invention, the proposed method for manufacturing the above type of anode consists in providing hollows on the anode surface, which hollows are then provided with a coating composed of two layers. The first, inner, layer is of a metal selected from the platinum family, or ruthenium dioxide, or platinum oxide and is 0.8 to 5 mμ thick; it may also be of lead dioxide, in which case it is 0.1 to 1 mm thick. The second, outer, layer is of manganese dioxide extracted from an aqueous solution of manganese sulphate by electroposition carried out during 20 to 100 hours at an anode current density of 5 to 100 $A/m^2$. The thickness of the second, outer, layer is 1 to 2 mm.

Other objects and advantages of the present invention will become more apparent from the following detailed description of preferred embodiments thereof to be read in conjunction with the accompanying drawings, wherein.

Figure 1:
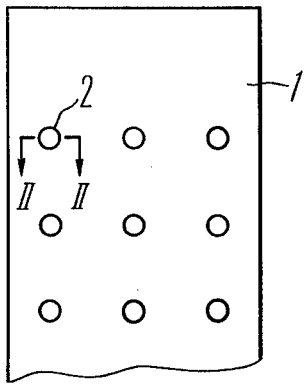
FIG. 1 is a view of a plate-shaped anode in accordance with the invention.

Referring now to the attached drawings, the proposed anode for producing electrolytic manganese dioxide is a plate 1 (FIG. 1) made of titanium. On the anode surface there are uniformly spaced through holes 2 whose total surface area amounts to at least 10 percent of that of the anode. The through holes 2 are provided with a coating which consists of an inner layer 3 (FIG. 2) and an outer layer 4. The inner layer 3 is of a metal selected from the platinum family, but it may also be of ruthenium dioxide or platinum oxide. The thickness of the inner layer 3 is 0.8 to 5 mμ. The inner layer 3 may also be of lead dioxide, in which case it is 0.1 to 1 mm thick. The outer layer 4 is of manganese dioxide and has a thickness of 1 to 2 mm. The through holes 2 are 2 to 5 mm in diameter.

Figure 3:
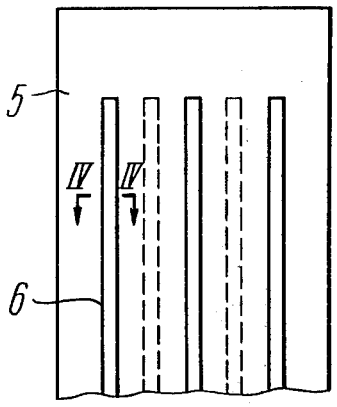
FIG. 3 is an alternative embodiment of a plate-shaped anode in accordance with the invention.

FIG. 3 is an alternative embodiment of the proposed anode. According to FIG. 3, the anode is a plate 5, whereon there are provided grooves 6 which are 0.5 to 1.5 mm deep. The total area of said grooves 6 is not less than 10 percent of the total surface area of the anode.

Figure 4:
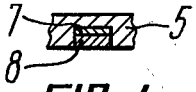
FIG. 4 is a magnified sectional view taken on the line IV—IV of FIG. 2.

The grooves 6 are also provided with a coating consisting of an inner layer 7 (FIG. 4) and an outer layer 8. The inner layer 7 is of a metal of the platinum family, or ruthenium dioxide, or platinum oxide and is 0.8 to 5 mμ thick. The inner layer may also be of lead dioxide, in which case it is 0.1 to 1 mm thick. The outer layer 8 is of manganese dioxide and has a thickness of 1 to 2 mm.

Figure 5:
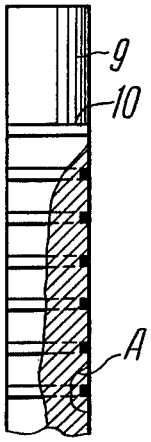
FIG. 5 is a cut-away view of a cylinder-shaped anode in accordance with the invention.
Figure 6:
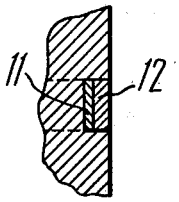
FIG. 6 is a magnified view of the area A of FIG. 5.

According to an alternative embodiment of the invention, the anode is a straight circular cylinder 9 (FIG. 5). On the surface of the cylinder 9 there are provided annular grooves 10 having a width of 1 to 2 mm and a depth of 0.5 to 2 mm. The total area of said grooves 10 is not less than 10 percent of the total surface area of the anode. Inside said grooves 10 there is applied a coating composed of an inner layer 11 (FIG. 6) and an outer layer 12. The inner layer 11 is of a metal selected from the platinum family; it may also be of ruthenium dioxide or platinum oxide. The inner layer 11 is 0.8 to 5 mμ thick. It may also be of lead dioxide, in which case it is 0.1 to 1 mm thick. The outer layer 12 is of manganese dioxide and has a thickness of 1 to 2 mm.

Figure 7:
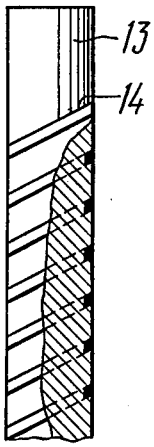
FIG. 7 is a cut-away view of an alternative embodiment of a cylinder-shaped anode in accordance with the invention.

FIG. 7 shows another alternative embodiment of the invention. According to FIG. 7, the anode is shaped as a cylinder 13, on whose surface there are provided spiral grooves 14. Inside the grooves 14 there is applied a coating which is similar to those of FIGS. 5 and 6.

One of the alternative embodiments of the proposed anode is manufactured as follows.

On the surface of the anode, i.e. on the surface of the titanium plate 1 (FIG. 1), there are provided the uniformly spaced through holes 2 with a diameter of 2 to 5 mm. This can be done by any known method, for example, by drilling. The total area of the through holes 2 must be at least 10 percent of the total surface area of the plate 1. In the through holes 2 there is applied a coating consisting of two layers. The first layer 3 (FIG. 2) of the coating is of a metal selected from the platinum family; it may also be of ruthenium dioxide or platinum oxide or lead dioxide. The layer 3 may be applied by any known method. A layer of ruthenium dioxide may be applied, for example, by thermally decomposing ruthenium hydrooxychloride at a temperature of 450° C. The second layer 4 of the coating is of manganese dioxide and is applied in the through holes 2 (FIG. 1) by being electrolytically extracted from an aqueous solution of manganese sulphate during 20 to 100 hours at an anode current density of 5 to 100 $A/m^2$. Said second layer 4 is applied as the anode is in operation to produce electrolytic manganese dioxide.

The anode of the foregoing type (FIG. 1) operates as follows.

At the initial stage of electrolysis, the entire surface of the anode 1 is coated with manganese dioxide, because, unlike the holes, the conductivity of the anode surface is sufficient to produce the first layers of a deposit of electrolytic manganese dioxide. Subsequently, depending on the passivity of titanium, i.e. the formation of a surface oxide film of titanium dioxide possessing a certain ohmic resistance, there takes place a redistribution of current. The main part of the current is directed from the anode through the two-layer coating to the anode deposit, where the current is uniformly distributed. Indicative of this fact is the more or less uniform thickness of the electrolytic manganese dioxide deposit on the anode.

If the removal of the electrolytic manganese dioxide deposited on the anode is done mechanically (manually or with the aid of mechanisms), the deposit is almost completely removed from the anode surface and only remains in the through holes 2.

The purpose of the through holes 2 is to prevent any direct mechanical action on the first, inner, layer 3 (FIG. 2) from a metal of the platinum family, ruthenium dioxide or platinum oxide, or lead dioxide which otherwise could take place during the removal of electrolytic manganese dioxide deposits or when transporting the anode. Besides, when the through holes 2 are filled with manganese dioxide, the latter serves as the protective layer 4 for the inner layer 3; as a result, there is no possibility of even a mechanical contact with the first, inner layer 3 in the course of the above-mentioned operations (removal of the deposit and transportation of the anodes). Hence, mechanical damage of the first, inner layer 3 of the coating is practically ruled out during the entire service life of the anode.

The purpose of the first layer, which consists of a metal selected from the platinum family, or of ruthenium dioxide, or platinum oxide, or lead dioxide, is to produce a conductive layer which would rule out excessive ohmic resistance in the surface titanium oxide film on the titanium - electrolytic manganese diode boundary and, in the final analysis, would eliminate high voltage across the bath during electrolysis.

Electrolysis of an aqueous solution of manganese sulphate proceeds as follows:

$$MnSO_4 + 2H_2O \rightarrow MnO_2 + H_2SO_4 + H_2.$$

Figure 2:
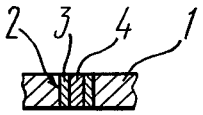
FIG. 2 is a magnified sectional view taken on the line II—II of FIG. 1.

Depending on the shape of the basic titanium material and the available equipment for working this material, there may be alternative embodiments of the proposed anode, which may be different from the embodiment of FIG. 1. These embodiments are shown in FIGS. 3, 5 and 7. The manufacture of these types of anode and their operation are similar to those of the anode of FIG. 1.

The proposed type of anode (this applies to all the above-mentioned embodiments) is used for producing electrolytic manganese dioxide. The electrolyte is an aqueous solution of manganese sulphate, containing 100 to 200 g/l of manganese sulphate and 20 to 100 g/l of sulphuric acid. The electrolysis is carried out at a temperature of 90 to 98° C. and an anode current density of 100 to 300 $A/m^2$. The cathode is of any conventional type and may be, for example, a lead cathode. The electrolysis proceeds at a cathode current density of 200 to 300 $A/m^2$. The reaction equation is as follows:

$$MnSO_4 + 2H_2O \rightarrow MnO_2 + H_2SO_4 + H_2.$$

The sulphuric acid produced as a result of the electrolysis is neutralized with metallic manganese or manganese carbonate. The voltage across the bath is 2.3 to 3.5 V; the duration of the electrolysis is 200 to 300 hours.

Upon the completion of the electrolysis, the anodes with manganese dioxide deposited on them are removed from the electrolyzer, whereafter the deposit is mechanically separated from the anode. The cleaned titanium anodes can be reused. The lumps of manganese dioxide thus produced are ground into powder with particle sizes of less than or equal to 0.2 mm. The product is then washed with a two- to three-percent soda solution and dried at a temperature of 90 to 105° C.

The current efficiency is 90 to 97 percent.

The end product (electrolytic manganese dioxide) contains no less than 90 to 92 mass percent of $MnO_2$ and no more than 8 mass percent of lower manganese oxides evaluated in terms of the $Mn_2O_3$ content.

The anode of this invention features a prolonged service life, as it eliminates damage of the first, inner, layer of the coating while mechanically removing the deposit of electrolytic manganese dioxide from said anode. In addition, the proposed anode design is conducive to a reduced consumption of costly metals of the platinum family in the course of the manufacture and operation of the anode.

Other objects and advantages of the present invention will be more readily understood from the following examples of preferred embodiments thereof.

EXAMPLE 1

On the surface of a titanium cylinder having a diameter of 20 mm and a length of 140 mm, there are provided, with the aid of a cutter, grooves which are 1 mm wide and 1 mm deep. The total area of the grooves is 15 percent of the total surface area of the anode.

Inside the grooves there is applied, with the aid of a brush, a layer of an aqueous solution of ruthenium hydroxichloride which is then heated to a temperature of 450° C. during 20 minutes. The thickness of the layer of ruthenium dioxide thus produced is 1 mμ. Onto the ruthenium dioxide layer there is electrolytically applied a layer of manganese dioxide extracted from an aqueous solution of manganese sulphate containing 100 g/l of manganese sulphate and 20 g/l of sulphuric acid, which is done at an anode current density of 5 $A/m^2$ and a temperature of 90° C. during 100 hours.

The anode thus made was used to produce electrolytic manganese dioxide at an anode current density of 200 $A/m^2$ over 20 cycles (keeping in mind that the duration of a single electrolysis cycle is 250 to 300 hours). During this period, the protective coating remained intact, and the voltage across the bath never went up, being kept within the range of 2.5 to 2.9 V.

EXAMPLE 2

Through holes with a diameter of 3 mm are provided in a titanium plate whose dimensions are 160 mm by 90 mm by 3 mm. The area of the through holes amounts to 12 percent of the total surface area of the anode. Inside the through holes there is applied a layer of an aqueous solution of platinichloride acid with a concentration of 12 percent by weight (in terms of the platinum content), whereupon the layer is heated to a temperature of 450° C. during 20 minutes. The thickness of the platinum oxide layer is 2 mμ. Onto the platinum oxide layer thus produced there is electrolytically applied a layer of manganese dioxide which is extracted from an aqueous solution containing 80 g/l of manganese sulphate and 30 g/l of sulphuric acid. The process is carried out at an anode current density of 40 $A/m^2$ and a temperature of 90° C. during 80 hours.

The anode was used to produce electrolytic manganese dioxide at an anode current density of 250 $A/m^2$ during 20 cycles (the duration of one cycle being 250 to 300 hours). The protective coating was intact, whereas the voltage across the bath was invariably maintained within the range of 2.8 to 3.2 V.

EXAMPLE 3

Grooves with a depth of 1 mm and a width of 1.5 mm are provided on a titanium plate with dimensions of 160 mm by 90 mm by 8 mm. The area of the grooves amounts to 10 percent of the total surface area of the anode. Pieces of platinum foil with a thickness of 20 mμ are spot-welded inside the grooves. The second layer of the coating is of manganese dioxide and applied as in Example 2.

The anode thus manufactured was used to produce electrolytic manganese dioxide at an anode current density of 300 $A/m^2$ during 20 cycles (the duration of one cycle being 250 to 300 hours). The protective coating was intact, and the voltage across the bath was always maintained between 3 and 3.5 V.

EXAMPLE 4

On the surface of a titanium cylinder with a diameter of 20 mm and a length of 140 mm there are made, with the aid of a cutter, helical grooves which are 2 mm wide and 1.5 mm deep. The area of the helical grooves amounts to 20 percent of the total surface area of the anode. Into the grooves there is applied a layer of an aqueous solution of ruthenium hydroxychloride with a concentration of 150 g/l, whereupon the layer is heated to a temperature of 450° C. during 20 minutes. The above operation is then repeated. The thickness of the layer of ruthenium dioxide thus produced is 1.8 to 2.0 mμ.

The second layer of manganese dioxide is applied as in Example 1.

The anode thus made was used to produce electrolytic manganese dioxide at an anode current density of 150 $A/m^2$ during 20 cycles (the duration of one cycle of electrolysis being 250 to 300 hours). The coating was intact, and the voltage across the bath was never in excess of 2.6 to 2.9 V.

EXAMPLE 5

The anode is manufactured as in Example 1, but in this case the indents on the cylinder surface are longitudinally extending grooves 1.5 mm wide and 2 mm deep.

The anode's performance is similar to that of the anode of Example 1.

EXAMPLE 6

On the surface of a titanium cylinder having a diameter of 20 mm and a length of 150 mm there are cut helical grooves 2 mm wide and 2 mm deep. The area of the grooves amounts to 30 percent of the total surface area of the anode.

Lead dioxide is applied electrochemically from an aqueous solution containing 350 g/l of $Pb(NO_3)_2$ and 5 g/l of $Cu(NO_3)_2$ during 18 hours with a current density increasing stepwise from 1 $A/m^2$ to 20 $A/m^2$. The temperature of the electrolyte is 70° C. Onto the layer of lead dioxide there is electrolytically applied a layer of manganese dioxide extracted from an aqueous solution of manganese sulphate containing 80 g/l of manganese sulphate and 30 g/l of sulphuric acid, which process is carried out during 20 hours at an anode current density of 50 $A/m^2$ and a temperature of 90° C.

The anode was used to produce electrolytic manganese dioxide at an anode current density of 150 $A/m^2$ during 16 cycles (the duration of one cycle of electrolysis was 250 to 300 hours). The protective coating remained intact, whereas the voltage across the bath was never higher than 2.6 to 3.3 V.

EXAMPLE 7

An aqueous solution of manganese sulphate, containing 120 to 125 g/l of manganese sulphate and 40 to 50 g/l of sulphuric acid is subjected to electrolysis. The electrolyte temperature is 90 to 96° C. The anode is of the type described in Example 4. The cathodes are strips of lead. The anode current density is 150 $A/m^2$, while the cathode current density is 200 $A/m^2$. The duration of the electrolysis is 300 hours. The voltage across the bath is 2.5 to 2.9 V. The current efficiency is 94 percent. The electrolytic manganese dioxide thus produced contains 91.1 percent of $MnO_2$ and belongs to the γ-crystal modification. This manganese dioxide is used to manufacture manganese-zinc Leclanche cells for flashlights. Such a cell has a diameter of 20 mm, a height of 55 mm, and a mass of 40 g. The rating of such a cell under the conditions of continuous discharge into a resistance of 3.33 ohms amounts to 1.07 ampere-hour, whereupon the final voltage is 0.67 V. When the cell is discharged into a resistance of 117 ohms to a final voltage of 1.0 V, the cell rating is 1.32 ampere-hour.

What is claimed is:

1. Anode for the electrolytic production of manganese dioxide, said anode being made of titanium and having indents on its surface, the total surface area of said indents being not less than 10 percent of the total surface area of said anode, said indents being provided with a coating inside said indents acting to prevent passivation of said anode, said coating being composed of two layers, a first, inner, layer of said coating being of a material selected from the group consisting of a metal of the platinum family, ruthenium dioxide and platinum oxide, in which case said coating has a thickness of 0.8 to 5 mμ, or being of lead dioxide, in which case said coating has a thickness of 0.1 to 1 mm, and a second, outer, layer of said coating being of manganese dioxide and having a thickness of 1 to 2 mm, said coating in said indents being protected from mechanical action used to remove manganese dioxide deposited on said anode when the same is used for the electrolytic production of manganese so that the coating remains in said indents to prevent passivation of said anode and thus permit the re-use of said anode for the electrolytic production of manganese dioxide.

2. An anode as claimed in claim 1, and being shaped as a plate, wherein said indents are through holes with a diameter of 2 to 5 mm.

3. An anode as claimed in claim 1, and being shaped as a plate, wherein said indents are grooves with a depth of 0.5 to 1.5 mm.

4. An anode as claimed in claim 1, and being shaped as a cylinder, wherein said indents are annular grooves having a width of 1 to 2 mm and a depth of 0.5 to 2.0 mm.

5. An anode as claimed in claim 1, and being shaped as a cylinder, wherein said indents are helical grooves having a width of 1 to 2 mm and a depth of 0.5 to 2.0 mm.

6. An anode as claimed in claim 1, and being shaped as a cylinder, wherein said indents are longitudinally extending grooves having a width of 1 to 2 mm and a depth of 0.5 to 2.0 mm.

* * * * *